US012188111B2

(12) United States Patent
Osuki et al.

(10) Patent No.: US 12,188,111 B2
(45) Date of Patent: Jan. 7, 2025

(54) AUSTENITIC STAINLESS STEEL MATERIAL

(71) Applicant: NIPPON STEEL CORPORATION, Marunouchi (JP)

(72) Inventors: Takahiro Osuki, Tokyo (JP); Shinnosuke Kurihara, Tokyo (JP); Kana Jotoku, Tokyo (JP); Yuhei Suzuki, Tokyo (JP); Shohgo Aota, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 375 days.

(21) Appl. No.: 17/757,126

(22) PCT Filed: Jan. 8, 2021

(86) PCT No.: PCT/JP2021/000448
§ 371 (c)(1),
(2) Date: Jun. 9, 2022

(87) PCT Pub. No.: WO2021/141107
PCT Pub. Date: Jul. 15, 2021

(65) Prior Publication Data

US 2022/0411908 A1 Dec. 29, 2022

(30) Foreign Application Priority Data

Jan. 10, 2020 (JP) ..... 2020-003010

(51) Int. Cl.

| | |
|---|---|
| ***C22C 38/58*** | (2006.01) |
| ***C21D 8/02*** | (2006.01) |
| ***C22C 38/00*** | (2006.01) |
| ***C22C 38/02*** | (2006.01) |
| ***C22C 38/44*** | (2006.01) |
| ***C22C 38/48*** | (2006.01) |
| ***C22C 38/54*** | (2006.01) |

(52) U.S. Cl.
CPC ..... *C22C 38/58* (2013.01); *C21D 8/0205* (2013.01); *C22C 38/001* (2013.01); *C22C 38/02* (2013.01); *C22C 38/44* (2013.01); *C22C 38/48* (2013.01); *C22C 38/54* (2013.01); *C21D 2211/001* (2013.01)

(58) Field of Classification Search
CPC ..... C22C 38/58; C22C 38/001; C22C 38/02; C22C 38/44; C22C 38/48; C22C 38/54; C22C 38/002; C22C 38/004; C22C 38/005; C22C 38/008; C22C 38/04; C22C 38/06; C22C 38/42; C22C 38/46; C22C 38/50; C22C 38/52; C22C 38/60; C21D 8/0205; C21D 2211/001; C21D 6/004; C21D 8/0226; C21D 1/26; C21D 8/0247; C21D 8/0263; C21D 8/0273; C21D 8/065; C21D 8/10; C21D 8/105; C21D 9/0081; C21D 9/08; C21D 9/46
See application file for complete search history.

(56) References Cited

U.S. PATENT DOCUMENTS

| | | | | |
|---|---|---|---|---|
| 2003/0015263 | A1* | 1/2003 | Kami ..... | C21D 8/0236 148/320 |
| 2010/0054983 | A1 | 3/2010 | Osuki et al. | |
| 2012/0141318 | A1 | 6/2012 | Osuki et al. | |
| 2019/0177808 | A1 | 6/2019 | Kurihara et al. | |
| 2019/0194787 | A1 | 6/2019 | Okada et al. | |
| 2020/0392611 | A1 | 12/2020 | Jotoku et al. | |

FOREIGN PATENT DOCUMENTS

| | | | |
|---|---|---|---|
| CN | 104611624 | A | 5/2015 |
| JP | 2011208269 | A * | 10/2011 |
| WO | 2018043565 | A1 | 3/2018 |
| WO | 2019168119 | A1 | 9/2019 |

OTHER PUBLICATIONS

JP 2011208269 A: Espacenet English machine translation (Year: 2011).*

* cited by examiner

*Primary Examiner* — Adil A. Siddiqui
(74) *Attorney, Agent, or Firm* — Greer Burns & Crain Ltd.

(57) ABSTRACT

An austenitic stainless steel material is provided that has high creep strength even when used at an average operation temperature of more than 600 to 750° C. after welding with higher heat input, and furthermore, has excellent stress relaxation cracking resistance even after use for a long time period at the average operation temperature after welding with higher heat input. The steel material has a chemical composition which consists of, in mass %, C: 0.030% or less, Si: 1.50% or less, Mn: 2.00% or less, P: 0.045% or less, S: 0.0300% or less, Cr: 15.00 to 25.00%, Ni: 8.00 to 20.00%, N: 0.050 to 0.250%, Nb: 0.10 to 1.00%, Mo: 0.05 to 5.00%, and B: 0.0005 to 0.0100%, with the balance being Fe and impurities, and a ratio of the dissolved N amount (mass %) with respect to the content of N (mass %) in the steel material is 0.40 to 0.90.

2 Claims, No Drawings

AUSTENITIC STAINLESS STEEL MATERIAL

TECHNICAL FIELD

The present disclosure relates to a steel material, and more specifically relates to an austenitic stainless steel material.

BACKGROUND ART

A steel material that is used in chemical plant facilities such as oil refinery plants and petrochemical plants is required to have high temperature strength. An austenitic stainless steel material is used as a steel material for use in these chemical plant facilities.

A chemical plant facility includes a plurality of apparatuses. The respective apparatuses included in a chemical plant facility are, for example, a vacuum distillation unit, a desulfurization unit, and a catalytic reforming unit. These apparatuses include a heating furnace pipe, a reactor, a tank, a heat exchanger, piping and the like. The average temperatures during operation of the respective apparatuses differ from each other. Hereinafter, the average temperature during operation is referred to as an "average operation temperature". The operation temperature varies significantly depending on the raw material and products processed at the chemical plant facility. Further, the apparatuses in a chemical plant facility also include multiple apparatuses that operate at an average operation temperature of more than 600 to 750° C.

An apparatus that operates at an average operation temperature of more than 600 to 750° C. needs to have high creep strength.

International Application Publication No. WO2018/043565 (Patent Literature 1) discloses improving the creep strength of an austenitic stainless steel material to be used in a high-temperature region. An austenitic stainless steel disclosed in Patent Literature 1 has a chemical composition which consists of, in mass %, C: 0.030% or less, Si: 0.10 to 1.00%, Mn: 0.20 to 2.00%, P: 0.040% or less, S: 0.010% or less, Cr: 16.0 to 25.0%, Ni: 10.0 to 30.0%, Mo: 0.1 to 5.0%, Nb: 0.20 to 1.00%, N: 0.050 to 0.300%, sol. Al: 0.0005 to 0.100%, B: 0.0010 to 0.0080%, Cu: 0 to 5.0%, W: 0 to 5.0%, Co: 0 to 1.0%, V: 0 to 1.00%, Ta: 0 to 0.2%, Hf: 0 to 0.20%, Ca: 0 to 0.010%, Mg: 0 to 0.010%, and rare earth metal: 0 to 0.10%, with the balance being Fe and impurities, and which satisfies Formula (1). Here, Formula (1) is as follows:

$$B+0.004-0.9C+0.017Mo^2 \geq 0.$$

CITATION LIST

Patent Literature

Patent Literature 1: International Application Publication No. WO2018/043565

SUMMARY OF INVENTION

Technical Problem

In this connection, when newly constructing a chemical plant facility or repairing a chemical plant facility, the steel material used for the apparatuses in the chemical plant facility is welded at the site where the chemical plant is located. In recent welding work, in order to reduce the number of welding passes, there are many cases in which welding with higher heat input for which the heat input is made large is adopted.

As described above, a steel material to be used at an average operation temperature of more than 600° C. is required to be excellent in high temperature strength. Consequently, the steel material tends to be thick-walled and/or larger in size. When such kind of steel material is welded, a large amount of residual stress is generated in a heat affected zone (hereinafter, also referred to as a "HAZ"). When such kind of steel material is used at an average operation temperature of more than 600° C., a stress relaxation process occurs in which the residual stress in the heat affected zone relaxes. In the stress relaxation process, carbides form within grains during the course of the recovery of residual stress in the heat affected zones, and secondary induced precipitation hardening occurs. A difference between the hardness within grains and the hardness at grain boundaries increases due to the secondary induced precipitation hardening. As a result, in some cases stress relaxation cracking occurs at the grain boundaries. Therefore, in a steel material to be used for a long time period at an average operation temperature of more than 600 to 750° C., it is desirable not only that the creep strength is high, but also that stress relaxation cracking can be suppressed, that is, that the stress relaxation cracking resistance is high.

The austenitic stainless steel proposed in Patent Literature 1 exhibits excellent creep strength. However, in Patent Literature 1, stress relaxation cracking resistance is not investigated.

An objective of the present disclosure is to provide an austenitic stainless steel material that has high creep strength even when used at an average operation temperature of more than 600 to 750° C. after welding with higher heat input, and furthermore, has excellent stress relaxation cracking resistance even after use for a long time period at an average operation temperature of more than 600 to 750° C. after welding with higher heat input.

Solution to Problem

An austenitic stainless steel material having:
a chemical composition consisting of, in mass %,
C: 0.030% or less,
Si: 1.50% or less,
Mn: 2.00% or less,
P: 0.045% or less,
S: 0.0300% or less,
Cr: 15.00 to 25.00%,
Ni: 8.00 to 20.00%.
N: 0.050 to 0.250%,
Nb: 0.10 to 1.00%,
Mo: 0.05 to 5.00%,
B: 0.0005 to 0.0100%,
Ti: 0 to 0.50%,
Ta: 0 to 0.50%,
V: 0 to 1.00%,
Zr: 0 to 0.10%,
Hf: 0 to 0.10%,
Cu: 0 to 4.00%,
W: 0 to 5.00%,
Co: 0 to 1.00%,
sol. Al: 0 to 0.100%,
Ca: 0 to 0.0200%,
Mg: 0 to 0.0200%,
rare earth metal: 0 to 0.100%,
Sn: 0 to 0.010%, As: 0 to 0.010%,
Zn: 0 to 0.010%,
Pb: 0 to 0.010%, and
Sb: 0 to 0.010%,
with the balance being Fe and impurities,
wherein
a ratio of a dissolved N amount (mass %) in the austenitic stainless steel material with respect to a content of N (mass %) in the austenitic stainless steel material is 0.40 to 0.90.

Advantageous Effects of Invention

The austenitic stainless steel material of the present disclosure has high creep strength even when used at an average operation temperature of more than 600 to 750° C. after welding with higher heat input, and furthermore, has excellent stress relaxation cracking resistance even after use for a long time period at an average operation temperature of more than 600 to 750° C. after welding with higher heat input.

DESCRIPTION OF EMBODIMENTS

The present inventors conducted studies regarding an austenitic stainless steel material that has high creep strength even when used at an average operation temperature of more than 600 to 750° C. after welding with higher heat input, and furthermore, has excellent stress relaxation cracking resistance even after use for a long time period at an average operation temperature of more than 600 to 750° C. after welding with higher heat input. Hereinafter, an environment in which an average operation temperature ranges from more than 600 to 750° C. is also referred to as a "high temperature environment".

The present inventors initially conducted studies relating to stress relaxation cracking resistance. It is considered that stress relaxation cracking occurs as a result of the following mechanism. In a high temperature environment, Cr carbides form at grain boundaries in the steel material. Consequently, Cr depleted zones (decarburized zones) are formed along grain boundaries. Cr depleted zones are soft. Therefore, a strength difference between the inside of grains that underwent secondary induced precipitation hardening and the Cr depleted zones along grain boundaries increases. As a result, stress relaxation cracking occurs.

Therefore, in order to increase stress relaxation cracking resistance, it is effective to suppress formation of Cr depleted zones along grain boundaries. In order to suppress formation of Cr depleted zones, it is necessary to suppress formation of Cr carbides in the steel material. To suppress formation of Cr carbides, it is effective to reduce the content of C, and furthermore, to contain Nb in the steel material to cause C in the steel material to combine with Nb as NbC in order to thereby inhibit C in the steel material from combining with Cr.

The present inventors conducted studies regarding chemical compositions for a steel material while taking into account the matters described above. As a result, the present inventors considered that if an austenitic stainless steel material has a chemical composition consisting of, in mass %, C: 0.030% or less, Si: 1.50% or less, Mn: 2.00% or less, P: 0.045% or less, S: 0.0300% or less, Cr: 15.00 to 25.00%, Ni: 8.00 to 20.00%, N: 0.050 to 0.250%, Nb: 0.10 to 1.00%, Mo: 0.05 to 5.00%, B: 0.0005 to 0.0100%, Ti: 0 to 0.50%, Ta: 0 to 0.50%, V: 0 to 1.00%, Zr: 0 to 0.10%, Hf: 0 to 0.10%, Cu: 0 to 4.00%, W: 0 to 5.00%, Co: 0 to 1.00%, sol. Al: 0 to 0.100%, Ca: 0 to 0.0200%, Mg: 0 to 0.0200%, rare earth metal: 0 to 0.100%, Sn: 0 to 0.010%, As: 0 to 0.010%, Zn: 0 to 0.010%, Pb: 0 to 0.010%, and Sb: 0 to 0.010%, with the balance being Fe and impurities, stress relaxation cracking resistance can be increased while also increasing creep strength.

With the aforementioned chemical composition, formation of Cr depleted zones can be suppressed. However, even with the aforementioned chemical composition, because C and Cr are contained, formation of Cr depleted zones will still occur. Therefore, the present inventors investigated suppressing stress relaxation cracking by means based on a different concept to the conventional means. The present inventors conducted studies regarding a method which keeps the content of C to 0.030% or less to thereby suppress the occurrence of Cr depleted zones to a minimum and, in addition, even if Cr depleted zones occur, strengthens the Cr depleted zones.

Because a Cr depleted zone is a decarburized zone, precipitation strengthening by carbides cannot be used in a Cr depleted zone. Therefore, the present inventors considered causing nitrides to precipitate in the steel material when used in a high temperature environment. Because C is not used in the formation of nitrides, Cr depleted zones (decarburized zones) do not become larger. During use in a high temperature environment, if nitrides precipitate in Cr depleted zones formed near grain boundaries, softening near grain boundaries can be suppressed by precipitation strengthening. Therefore, a strength difference between the inside of the grains that underwent secondary induced precipitation hardening and the Cr depleted zones formed along the grain boundaries can be reduced, and stress relaxation cracking resistance can be increased. In addition, by strengthening the Cr depleted zones, creep strength also increases.

In addition, in order to exhibit the aforementioned stress relaxation cracking suppression effect and high creep strength together, during use in a high temperature environment, it is important that, in addition to securing a dissolved N amount for forming nitrides which act to perform precipitation strengthening of Cr depleted zones and the inside of grains, nitrides are caused to precipitate in advance in the steel material prior to use. By forming nitrides in the steel material prior to use, a pinning effect of the nitrides occurs and the grains can be refined. If the grains can be refined, the amount (coverage) of Cr carbides precipitating at the grain boundaries will be low, and in addition, the amount of grain-boundary segregation of phosphorus (P) and sulfur (S) will be small. In such a case, a decrease in the hardness of grain boundaries and near grain boundaries can be suppressed, and a strength difference between the inside of the grains and the grain boundaries and Cr depleted zones can be reduced. Therefore, the stress relaxation cracking resistance of the steel material will increase.

As described above, the present inventors considered that by forming nitrides and refining grains by the pinning effect in a steel material prior to use in a high temperature environment, and also forming nitrides in the steel material to strengthen Cr depleted zones during use in a high temperature environment, stress relaxation cracking resistance can be increased. Further, as the result of taking into consideration the compatibility between the creep strength and the stress relaxation cracking resistance, the present inventors discovered that if a steel material has the aforementioned chemical composition and, furthermore, the ratio of the dissolved N amount in the steel material to the content of N in the steel material is 0.40 to 0.90, it is possible to achieve compatibility between the creep strength and the stress relaxation cracking resistance.

The austenitic stainless steel material of the present embodiment that has been completed based on the above findings is as follows.

[1]

An austenitic stainless steel material, having:

a chemical composition consisting of, in mass %,

C: 0.030% or less,

Si: 1.50% or less,

Mn: 2.00% or less,

P: 0.045% or less,

S: 0.0300% or less,

Cr: 15.00 to 25.00%,

Ni: 8.00 to 20.00%,

N: 0.050 to 0.250%,

Nb: 0.10 to 1.00%,

Mo: 0.05 to 5.00%,

B: 0.0005 to 0.0100%,

Ti: 0 to 0.50%,

Ta: 0 to 0.50%,

V: 0 to 1.00%,

Zr: 0 to 0.10%,

Hf: 0 to 0.10%,

Cu: 0 to 4.00%,

W: 0 to 5.00%,

Co: 0 to 1.00%, sol. Al: 0 to 0.100%,

Ca: 0 to 0.0200%,

Mg: 0 to 0.0200%, rare earth metal: 0 to 0.100%,

Sn: 0 to 0.010%,

As: 0 to 0.010%,

Zn: 0 to 0.010%,

Pb: 0 to 0.010%, and

Sb: 0 to 0.010%, with the balance being Fe and impurities, wherein a ratio of a dissolved N amount (mass %) in the austenitic stainless steel material with respect to a content of N (mass %) in the austenitic stainless steel material is 0.40 to 0.90.

[2]

The austenitic stainless steel material according to [1], wherein the chemical composition contains at least one or more elements belonging to any group among a first group to a fourth group:

first group:

Ti: 0.01 to 0.50%,

Ta: 0.01 to 0.50%,

V: 0.01 to 1.00%,

Zr: 0.01 to 0.10%, and

Hf: 0.01 to 0.10%;

second group:

Cu: 0.01 to 4.00%,

W: 0.01 to 5.00%, and

Co: 0.01 to 1.00%;

third group:

sol. Al: 0.001 to 0.100%;

fourth group:

Ca: 0.0001 to 0.0200%,

Mg: 0.0001 to 0.0200%, and rare earth metal: 0.001 to 0.100%.

Hereunder, the austenitic stainless steel material of the present embodiment are described in detail. The symbol "%" in relation to an element means "mass %" unless specifically stated otherwise.

[Regarding Chemical Composition]

The chemical composition of the austenitic stainless steel material of the present embodiment contains the following elements.

C: 0.030% or Less

Carbon (C) is unavoidably contained. In other words, the content of C is more than 0%. C forms $M_{23}C_6$-type carbides at grain boundaries. In this case, Cr depleted zones form at grain boundaries, and the stress relaxation cracking resistance of the steel material decreases. If the content of C is more than 0.030%, even if the contents of other elements are within the range of the present embodiment, the stress relaxation cracking resistance of the steel material will markedly decrease. Therefore, the content of C is 0.030% or less. A preferable upper limit of the content of C is 0.026%, more preferably is 0.024%, further preferably is 0.022%, further preferably is 0.020%, and further preferably is 0.018%. The content of C is preferably as low as possible. However, if the content of C is excessively reduced, the production cost will increase. Therefore, for industrial production, a preferable lower limit of the content of C is 0.001%, and further preferably is 0.002%.

Si: 1.50% or Less

Silicone (Si) is unavoidably contained. In other words, the content of Si is more than 0%. Si deoxidizes the steel in the steel making process. In addition, when the steel material is used in a high temperature environment (an average operation temperature of more than 600 to 750° C.), Si increases the oxidation resistance and steam oxidation resistance of the steel material. If even a small amount of Si is contained, the aforementioned effects are obtained to a certain extent. However, if the content of Si is more than 1.50%, even if the contents of other elements are within the range of the present embodiment, weld cracking susceptibility will markedly increase. In addition, sigma phase (σ phase) will form in the steel material due to use for a long time period in a high temperature environment. The σ phase will reduce the toughness of the steel material. Therefore, the content of Si is 1.50% or less. A preferable lower limit of the content of Si is 0.01%, more preferably is 0.05%, further preferably is 0.10%, further preferably is 0.15%, and further preferably is 0.18%. A preferable upper limit of the content of Si is 1.40%, more preferably is 1.20%, further preferably is 1.00%, further preferably is 0.80%, further preferably is 0.70%, further preferably is 0.60%, and further preferably is 0.50%.

Mn: 2.00% or Less

Manganese (Mn) is unavoidably contained. In other words, the content of Mn is more than 0%. Mn combines with S in the steel material to form MnS, and thereby increases the hot workability of the steel material. Mn also deoxidizes the weld zone of the steel material during welding. If even a small amount of Mn is contained, the aforementioned effects are obtained to a certain extent. However, if the content of Mn is more than 2.00%, even if the contents of other elements are within the range of the present embodiment, sigma phase (σ phase) will easily form during use in a high temperature environment. The σ phase will reduce the toughness of the steel material during use in a high temperature environment. Therefore, the content of Mn is 2.00% or less. A preferable lower limit of the content of Mn is 0.01%, more preferably is 0.10%, further preferably is 0.40%, further preferably is 0.50%, and further preferably is 0.60%. A preferable upper limit of the content of Mn is 1.80%, more preferably is 1.60%, further preferably is 1.50%, further preferably is 1.30%, further preferably is 1.10%, and further preferably is 0.95%.

P: 0.045% or Less

Phosphorus (P) is unavoidably contained. In other words, the content of P is more than 0%. During welding with higher heat input, P segregates at grain boundaries of the steel material. As a result, the stress relaxation cracking resistance decreases. If the content of P is more than 0.045%, even if the contents of other elements are within the range of the present embodiment, the stress relaxation cracking resistance will decrease. Therefore, the content of P is 0.045% or less. A preferable upper limit of the content of P is 0.035%, and more preferably is 0.030%. The content of P is preferably as low as possible. However, excessively reducing the content of P will raise the production cost of the steel material. Therefore, when taking into consideration normal industrial production, a preferable lower limit of the content of P is 0.001%, and more preferably is 0.002%.

S: 0.0300% or Less

Sulfur (S) is unavoidably contained. In other words, the content of S is more than 0%. During welding with higher heat input, S segregates at grain boundaries of the steel material. As a result, the stress relaxation cracking resistance decreases. If the content of S is more than 0.0300%, even if the contents of other elements are within the range of the present embodiment, the stress relaxation cracking resistance will decrease. Therefore, the content of S is 0.0300% or less. A preferable upper limit of the content of S is 0.0150%, more preferably is 0.0100%, further preferably is 0.0050%, and further preferably is 0.0030%. The content of S is preferably as low as possible. However, excessively reducing the content of S will raise the production cost of the steel material. Therefore, when taking into consideration normal industrial production, a preferable lower limit of the content of S is 0.0001%, and more preferably is 0.0002%.

Cr: 15.00 to 25.00%

Chromium (Cr) increases the oxidation resistance and corrosion resistance of the steel material during use of the steel material in a high temperature environment. If the content of Cr is less than 15.00%, even if the contents of other elements are within the range of the present embodiment, the aforementioned effect will not be sufficiently obtained. On the other hand, if the content of Cr is more than 25.00%, even if the contents of other elements are within the range of the present embodiment, the stability of austenite in the steel material in a high temperature environment will decrease. In this case, the creep strength of the steel material will decrease. Therefore, the content of Cr is 15.00 to 25.00%. A preferable lower limit of the content of Cr is 16.00%, more preferably is 16.20%, and further preferably is 16.40%. A preferable upper limit of the content of Cr is 24.00%, more preferably is 23.00%, further preferably is 22.00%, further preferably is 21.00%, further preferably is 20.00%, and further preferably is 19.00%.

Ni: 8.00 to 20.00%

Nickel (Ni) stabilizes austenite and increases the creep strength of the steel material in a high temperature environment. If the content of Ni is less than 8.00%, even if the contents of other elements are within the range of the present embodiment, the aforementioned effect will not be sufficiently obtained. On the other hand, if the content of Ni is more than 20.00%, the aforementioned effect will be saturated and, furthermore, the production cost will increase. Therefore, the content of Ni is 8.00 to 20.00%. A preferable lower limit of the content of Ni is 8.50%, more preferably is 9.00%, further preferably is 9.20%, and further preferably is 9.40%. A preferable upper limit of the content of Ni is 18.00%, more preferably is 16.00%, further preferably is 15.00%, and further preferably is 14.00%.

N: 0.050 to 0.250%

Nitrogen (N) dissolves in the matrix (parent phase) and stabilizes austenite. In addition, the dissolved N forms fine nitrides in the steel material during use in a high temperature environment. Because the fine nitrides strengthen Cr depleted zones, the stress relaxation cracking resistance of the steel material increases. The fine nitrides formed during use in a high temperature environment also increase the creep strength by precipitation strengthening. If the content of N is less than 0.050%, even if the contents of other elements are within the range of the present embodiment, the aforementioned effects will not be sufficiently obtained. On the other hand, if the content of N is more than 0.250%, even if the contents of other elements are within the range of the present embodiment, Cr nitrides ($Cr_2N$) will form at grain boundaries. In such a case, the amount of nitrides precipitated near grain boundaries will decrease. Consequently, the strength near grain boundaries will decrease. As a result, a difference between the strength within the grains and the strength at the grain boundaries will increase, and the stress relaxation cracking resistance will decrease. Therefore, the content of N is 0.050 to 0.250%. A preferable lower limit of the content of N is 0.052%, more preferably is 0.055%, and further preferably is 0.060%. A preferable upper limit of the content of N is 0.200%, more preferably is 0.150%, and further preferably is 0.120%.

Nb: 0.10 to 1.00%

Niobium (Nb), together with N, forms fine nitrides in the steel material during use in a high temperature environment. Because the fine nitrides strengthen Cr depleted zones, the stress relaxation cracking resistance of the steel material increases. The fine nitrides formed during use in a high temperature environment also increase the creep strength by precipitation strengthening. Nb also combines with C to form MX-type Nb carbides. When Nb carbides form and fix C, the amount of dissolved C in the steel material decreases. By this means, during use of the steel material in a high temperature environment, formation of Cr carbides at grain boundaries is suppressed and the stress relaxation cracking resistance of the steel material increases. If the content of Nb is less than 0.10%, even if the contents of other elements are within the range of the present embodiment, the aforementioned effects will not be sufficiently obtained. On the other hand, if the content of Nb is more than 1.00%, even if the contents of other elements are within the range of the present embodiment, nitrides and carbides will excessively form. In this case, the strength within the grains will become excessively high, and a strength difference between the inside of the grains and the grain boundaries will be large. Consequently, stress concentration will occur at grain boundary interfaces, and the stress relaxation cracking resistance will decrease. Therefore, the content of Nb is 0.10 to 1.00%. A preferable lower limit of the content of Nb is 0.20%, more preferably is 0.23%, further preferably is 0.25%, further preferably is 0.30%, and further preferably is 0.35%. A preferable upper limit of the content of Nb is 0.80%, more preferably is 0.60%, and further preferably is 0.50%.

Mo: 0.05 to 5.00%

Molybdenum (Mo) suppresses formation and growth of $M_{23}C_6$-type Cr carbides at grain boundaries during use of the steel material in a high temperature environment. As a result, the stress relaxation cracking resistance of the steel material increases. In addition, as a solid-solution strengthening element, Mo increases the creep strength of the steel material in a high temperature environment. If the content of Mo is less than 0.05%, even if the contents of other elements are within the range of the present embodiment, the aforementioned effects will not be sufficiently obtained. On the other hand, if the content of Mo is more than 5.00%, even if the contents of other elements are within the range of the present embodiment, formation of intermetallic compounds such as Laves phases within grains will be markedly promoted. In such a case, the strength within the grains will be excessively high, and the strength difference between the inside of the grains and the grain boundaries will be large. Consequently, stress concentration will occur at grain boundary interfaces, and the stress relaxation cracking resistance will decrease. Therefore, the content of Mo is 0.05 to 5.00%. A preferable lower limit of the content of Mo is 0.06%, more preferably is 0.10%, further preferably is 0.15%, further preferably is 0.20%, further preferably is 0.24%, further preferably is 0.28%, and further preferably is 0.32%. A preferable upper limit of the content of Mo is 4.00%, more preferably is 3.00%, further preferably is 2.00%, further preferably is 1.50%, and further preferably is 1.00%.

B: 0.0005 to 0.0100%

Boron (B) segregates at grain boundaries during use of the steel material in a high temperature environment, and thereby increases the grain boundary strength. Therefore, B increases the stress relaxation cracking resistance of the steel material. If the content of B is less than 0.0005%, even if the contents of other elements are within the range of the present embodiment, the aforementioned effect will not be sufficiently obtained. On the other hand, if the content of B is more than 0.0100%, even if the contents of other elements are within the range of the present embodiment, formation of Cr carbides at the grain boundaries will be promoted. In such a case, the stress relaxation cracking resistance of the steel material will decrease. Therefore, the content of B is 0.0005 to 0.0100%. A preferable lower limit of the content of B is 0.0012%, more preferably is 0.0014%, further preferably is 0.0016%, further preferably is 0.0018%, and further preferably is 0.0020%. A preferable upper limit of the content of B is 0.0080%, more preferably is 0.0060%, further preferably is 0.0050%, further preferably is 0.0040%, further preferably is 0.0035%, and further preferably is 0.0030%.

The balance in the chemical composition of the austenitic stainless steel material according to the present embodiment is Fe and impurities. Here, the term "impurities" refers to elements which, during industrial production of the austenitic stainless steel material, are mixed in from ore or scrap that is used as a raw material, or from the production environment or the like, and which are allowed within a range that does not adversely affect the austenitic stainless steel material of the present embodiment.

Among the impurities, the respective contents of Sn, As, Zn, Pb and Sb are as follows.

Sn: 0 to 0.010%
As: 0 to 0.010%
Zn: 0 to 0.010%
Pb: 0 to 0.010%
Sb: 0 to 0.010%

Tin (Sn), arsenic (As), zinc (Zn), lead (Pb) and antimony (Sb) are each an impurity. The content of Sn may be 0%. Similarly, the content of As may be 0%. The content of Zn may be 0%. The content of Pb may be 0%. The content of Sb may be 0%. If contained, each of these elements segregates at grain boundaries and lowers the fusing point of the grain boundaries, and reduces the bonding strength of the grain boundaries. If the content of Sn is more than 0.010%, even if the contents of other elements are within the range of the present embodiment, the hot workability and weldability of the steel material will decrease. Similarly, if the content of As is more than 0.010%, even if the contents of other elements are within the range of the present embodiment, the hot workability and weldability of the steel material will decrease. If the content of Zn is more than 0.010%, even if the contents of other elements are within the range of the present embodiment, the hot workability and weldability of the steel material will decrease. If the content of Pb is more than 0.010%, even if the contents of other elements are within the range of the present embodiment, the hot workability and weldability of the steel material will decrease. If the content of Sb is more than 0.010%, even if the contents of other elements are within the range of the present embodiment, the hot workability and weldability of the steel material will decrease. Therefore, the content of Sn is 0 to 0.010%. The content of As is 0 to 0.010%. The content of Zn is 0 to 0.010%. The content of Pb is 0 to 0.010%. The content of Sb is 0 to 0.010%.

[Regarding Optional Elements]

[First Group of Optional Elements]

The chemical composition of the austenitic stainless steel material according to the present embodiment may also contain one or more elements selected from the group consisting of Ti, Ta, V, Zr and Hf in lieu of a part of Fe. These elements each combine with C to form a carbide and thereby reduce the amount of dissolved C, and in this way these elements further increase the stress relaxation cracking resistance of the steel material.

Ti: 0 to 0.50%

Titanium (Ti) is an optional element, and need not be contained. In other words, the content of Ti may be 0%. When contained, Ti combines with C in the steel material to form carbides. By this means, the formation of Cr carbides is suppressed, and the stress relaxation cracking resistance of the steel material further increases. If even a small amount of Ti is contained, the aforementioned effect is obtained to a certain extent. However, if the content of Ti is more than 0.50%, even if the contents of other elements are within the range of the present embodiment, carbides will excessively precipitate in the grains. In such a case, the strength within the grains will become excessively high, and the strength difference between the inside of the grains and the grain boundaries will be large. Consequently, stress concentration will occur at grain boundary interfaces, and the stress relaxation cracking resistance will, on the contrary, decrease. Therefore, the content of Ti is 0 to 0.50%. A preferable lower limit of the content of Ti is more than 0%, more preferably is 0.01%, further preferably is 0.02%, and further preferably is 0.03%. A preferable upper limit of the content of Ti is 0.45%, more preferably is 0.40%, further preferably is 0.35%, and further preferably is 0.30%.

Ta: 0 to 0.50%

Tantalum (Ta) is an optional element, and need not be contained. In other words, the content of Ta may be 0%. When contained, Ta combines with C to form carbides. By this means, the formation of Cr carbides is suppressed, and the stress relaxation cracking resistance of the steel material further increases. If even a small amount of Ta is contained, the aforementioned effect is obtained to a certain extent. However, if the content of Ta is more than 0.50%, even if the contents of other elements are within the range of the present embodiment, carbides will excessively precipitate in the grains. In such a case, the strength within the grains will become excessively high, and the strength difference between the inside of the grains and the grain boundaries will be large. Consequently, stress concentration will occur at grain boundary interfaces, and the stress relaxation cracking resistance will, on the contrary, decrease. Therefore, the content of Ta is 0 to 0.50%. A preferable lower limit of the content of Ta is more than 0%, more preferably is 0.01%, further preferably is 0.02%, further preferably is 0.03%, and further preferably is 0.05%. A preferable upper limit of the content of Ta is 0.45%, more preferably is 0.40%, further preferably is 0.35%, and further preferably is 0.30%.

V: 0 to 1.00%

Vanadium (V) is an optional element, and need not be contained. In other words, the content of V may be 0%. When contained, V combines with C to form carbides. By this means, the formation of Cr carbides is suppressed, and the stress relaxation cracking resistance of the steel material further increases. If even a small amount of V is contained, the aforementioned effect is obtained to a certain extent. However, if the content of V is more than 1.00%, even if the contents of other elements are within the range of the present embodiment, carbides will excessively precipitate in the grains. In such a case, the strength within the grains will become excessively high, and the strength difference between the inside of the grains and the grain boundaries will be large. Consequently, stress concentration will occur at grain boundary interfaces, and the stress relaxation cracking resistance will, on the contrary, decrease. Therefore, the content of V is 0 to 1.00%. A preferable lower limit of the content of V is more than 0%, more preferably is 0.01%, further preferably is 0.02%, further preferably is 0.04%, and further preferably is 0.06%. A preferable upper limit of the content of V is 0.50%, more preferably is 0.40%, further preferably is 0.35%, and further preferably is 0.30%.

Zr: 0 to 0.10%

Zirconium (Zr) is an optional element, and need not be contained. In other words, the content of Zr may be 0%. When contained, Zr combines with C to form carbides. By this means, the formation of Cr carbides is suppressed, and the stress relaxation cracking resistance of the steel material further increases. If even a small amount of Zr is contained, the aforementioned effect is obtained to a certain extent. However, if the content of Zr is more than 0.10%, even if the contents of other elements are within the range of the present embodiment, carbides will excessively precipitate in the grains. In such a case, the strength within the grains will become excessively high, and the strength difference between the inside of the grains and the grain boundaries will be large. Consequently, stress concentration will occur at grain boundary interfaces, and the stress relaxation cracking resistance will, on the contrary, decrease. Therefore, the content of Zr is 0 to 0.10%. A preferable lower limit of the content of Zr is more than 0%, more preferably is 0.01%, and further preferably is 0.02%. A preferable upper limit of the content of Zr is 0.09%, more preferably is 0.08%, further preferably is 0.07%, and further preferably is 0.06.

Hf: 0 to 0.10%

Hafnium (Hf) is an optional element, and need not be contained. In other words, the content of Hf may be 0%. When contained, Hf combines with C to form carbides. By this means, the formation of Cr carbides is suppressed, and the stress relaxation cracking resistance of the steel material further increases. If even a small amount of Hf is contained, the aforementioned effect is obtained to a certain extent. However, if the content of Hf is more than 0.10%, even if the contents of other elements are within the range of the present embodiment, carbides will excessively precipitate in the grains. In such a case, the strength within the grains will become excessively high, and the strength difference between the inside of the grains and the grain boundaries will be large. Consequently, stress concentration will occur at grain boundary interfaces, and the stress relaxation cracking resistance will, on the contrary, decrease. Therefore, the content of Hf is 0 to 0.10%. A preferable lower limit of the content of Hf is more than 0%, more preferably is 0.01%, and further preferably is 0.02%. A preferable upper limit of the content of Hf is 0.09%, more preferably is 0.08%, further preferably is 0.07%, and further preferably is 0.06%.

[Second Group of Optional Elements]

The chemical composition of the austenitic stainless steel material according to the present embodiment may also contain one or more elements selected from the group consisting of Cu, W and Co in lieu of a part of Fe. Each of these elements further increases the creep strength of the steel material at an average operation temperature of more than 600 to 750° C.

Cu: 0 to 4.00%

Copper (Cu) is an optional element, and need not be contained. In other words, the content of Cu may be 0%. When contained, during use of the steel material in a high temperature environment, Cu precipitates as a Cu phase in the grains, and further increases the creep strength of the steel material by precipitation strengthening. If even a small amount of Cu is contained, the aforementioned effect is obtained to a certain extent. However, if the content of Cu is more than 4.00%, during use in a high temperature environment, in some cases the precipitation amount of Cu phase will increase and the creep ductility will decrease. Therefore, the content of Cu is 0 to 4.00%. A preferable lower limit of the content of Cu is more than 0%, more preferably is 0.01%, further preferably is 0.05%, further preferably is 0.10%, further preferably is 0.20%, and further preferably is 0.30%. A preferable upper limit of the content of Cu is 3.50%, more preferably is 3.00%, further preferably is 2.50%, and further preferably is 2.00%.

W: 0 to 5.00%

Tungsten (W) is an optional element, and need not be contained. In other words, the content of W may be 0%. When contained, during use of the steel material in a high temperature environment, W further increases the creep strength of the steel material by solid-solution strengthening. If even a small amount of W is contained, the aforementioned effect is obtained to a certain extent. However, if the content of W is more than 5.00%, even if the contents of other elements are within the range of the present embodiment, the stability of austenite will decrease and the toughness will decrease. Therefore, the content of W is 0 to 5.00%. A preferable lower limit of the content of W is more than 0%, more preferably is 0.01%, further preferably is 0.10%, further preferably is 0.20%, further preferably is 0.25%, and further preferably is 0.30%. A preferable upper limit of the content of W is 4.00%, more preferably is 3.00%, further preferably is 2.50%, further preferably is 2.00%, and further preferably is 1.50%.

Co: 0 to 1.00%

Cobalt (Co) is an optional element, and need not be contained. In other words, the content of Co may be 0%. When contained, Co stabilizes austenite and further increases the creep strength of the steel material at an average operation temperature of more than 600 to 750° C. If even a small amount of Co is contained, the aforementioned effects are obtained to a certain extent. However, if the content of Co is more than 1.00%, even if the contents of other elements are within the range of the present embodiment, the raw material cost will increase. Therefore, the content of Co is 0 to 1.00%. A preferable lower limit of the content of Co is more than 0%, more preferably is 0.01%, further preferably is 0.04%, and further preferably is 0.10%. A preferable upper limit of the content of Co is 0.90%, more preferably is 0.80%, further preferably is 0.70%, and further preferably is 0.60%.

[Third Group of Optional Elements]

The chemical composition of the austenitic stainless steel material according to the present embodiment may, in addition, contain Al in lieu of a part of Fe. Al deoxidizes the steel in the steel making process.

Sol. Al: 0 to 0.100%

Aluminum (Al) is an optional element, and need not be contained. In other words, the content of Al may be 0%. When contained, Al deoxidizes the steel in the steel making process. If even a small amount of Al is contained, the aforementioned effect is obtained to a certain extent. However, if the content of sol. Al is more than 0.100%, even if the contents of other elements are within the range of the present embodiment, the workability and ductility of the steel material will decrease. Therefore, the content of sol. Al is 0 to 0.100%. A preferable lower limit of the content of sol. Al is more than 0%, more preferably is 0.001%, further preferably is 0.005%, and further preferably is 0.010%. A preferable upper limit of the content of Al is 0.080%, more preferably is 0.060%, and further preferably is 0.040%. In the present embodiment, the content of sol. Al means the content of acid-soluble Al (sol. Al).

[Fourth Group of Optional Elements]

The chemical composition of the austenitic stainless steel material according to the present embodiment may also contain one or more elements selected from the group consisting of Ca, Mg and rare earth metal (REM) in lieu of a part of Fe. Each of these elements increases the hot workability of the steel material.

Ca: 0 to 0.0200%

Calcium (Ca) is an optional element, and need not be contained. In other words, the content of Ca may be 0%. When contained, Ca fixes O (oxygen) and S (sulfur) as inclusions, and thereby increases the hot workability of the steel material. Ca also fixes S, and thereby suppresses grain-boundary segregation of S. By this means, embrittlement cracks in the HAZ during welding are reduced. If even a small amount of Ca is contained, the aforementioned effects are obtained to a certain extent. However, if the content of Ca is more than 0.0200%, even if the contents of other elements are within the range of the present embodiment, the cleanliness of the steel material will decrease, and the hot workability of the steel material will, on the contrary, decrease. Therefore, the content of Ca is 0 to 0.0200%. A preferable lower limit of the content of Ca is more than 0%, more preferably is 0.0001%, further preferably is 0.0002%, and further preferably is 0.0005%. A preferable upper limit of the content of Ca is 0.0150%, more preferably is 0.0100%, further preferably is 0.0080%, further preferably is 0.0050%, and further preferably is 0.0040%.

Mg: 0 to 0.0200%

Magnesium (Mg) is an optional element, and need not be contained. In other words, the content of Mg may be 0%. When contained, Mg fixes O (oxygen) and S (sulfur) as inclusions, and thereby increases the hot workability of the steel material. Mg also fixes S, and thereby suppresses grain-boundary segregation of S. By this means, embrittlement cracks in the HAZ during welding are reduced. If even a small amount of Mg is contained, the aforementioned effects are obtained to a certain extent. However, if the content of Mg is more than 0.0200%, even if the contents of other elements are within the range of the present embodiment, the cleanliness of the steel material will decrease, and the hot workability of the steel material will, on the contrary, decrease. Therefore, the content of Mg is 0 to 0.0200%. A preferable lower limit of the content of Mg is more than 0%, more preferably is 0.0001%, further preferably is 0.0002%, and further preferably is 0.0005%. A preferable upper limit of the content of Mg is 0.0150%, more preferably is 0.0100%, further preferably is 0.0080%, further preferably is 0.0050%, and further preferably is 0.0040%.

Rare Earth Metal: 0 to 0.100%

Rare earth metal (REM) is an optional element, and need not be contained. In other words, the content of REM may be 0%. When contained, REM fixes O (oxygen) and S (sulfur) as inclusions, and thereby increases the hot workability of the steel material. However, if the content of REM is too high, even if the contents of other elements are within the range of the present embodiment, the hot workability of the steel material will decrease. Therefore, the content of REM is 0 to 0.100%. A preferable lower limit of the content of REM is more than 0%, more preferably is 0.001%, and further preferably is 0.002%. A preferable upper limit of the content of REM is 0.080%, and further preferably is 0.060%.

In the present description, the term "REM" includes at least one or more elements among Sc, Y, and lanthanoids (elements from La with atomic number 57 through Lu with atomic number 71), and the term "content of REM" means the total content of these elements.

[Method for Analyzing Chemical Composition of Austenitic Stainless Steel Material]

The chemical composition of the austenitic stainless steel material of the present embodiment can be determined by a well-known component analysis method. Specifically, when the austenitic stainless steel material is a steel pipe, a drill with a diameter of 5 mm is used to perform piercing at a center position of the wall thickness to generate machined chips, and the machined chips are collected. In a case where the austenitic stainless steel material is a steel plate, a drill with a diameter of 5 mm is used to perform piercing at the center position of the plate width and also at the center position of the plate thickness to generate machined chips, and the machined chips are collected. In a case where the austenitic stainless steel material is a steel bar, a drill with a diameter of 5 mm is used to perform piercing at an R/2 position to generate machined chips, and the machined chips are collected. Here, the term "R/2 position" means the center position of a radius R in a cross section perpendicular to the longitudinal direction of the steel bar.

The collected machined chips are dissolved in acid to obtain a liquid solution. The liquid solution is subjected to ICP-AES (Inductively Coupled Plasma Atomic Emission Spectrometry), and elementary analysis of the chemical composition is performed. The content of C and the content of S are determined by a well-known high-frequency combustion method (combustion-infrared absorption method). The content of N is determined using a well-known inert gas fusion-thermal conductivity method.

[Regarding Dissolved N Ratio]

The ratio of the dissolved N amount (mass %) in the austenitic stainless steel material of the present embodiment with respect to the content of N (mass %) in the steel material is defined as the "dissolved N ratio". That is, the dissolved N ratio is represented by the following formula.

Dissolved N ratio=dissolved N amount (mass %) in steel material/content of N (mass %) in steel material In the austenitic stainless steel material of the present embodiment, the dissolved N ratio is 0.40 to 0.90.

If the dissolved N ratio is less than 0.40, there will be too many nitrides in the austenitic stainless steel material. In this case, because the dissolved N amount in the steel material will be insufficient, fine nitrides will not sufficiently precipitate in Cr depleted zones during use in a high temperature environment. Therefore, the stress relaxation cracking resistance and the creep strength of the steel material in a high temperature environment will decrease. On the other hand, if the dissolved N ratio is more than 0.90, there will be too few nitrides in the austenitic stainless steel material. In this case, grain refining by nitrides will be insufficient. As a result, the strength of the grain boundaries will decrease and the stress relaxation cracking resistance will decrease.

If the dissolved N ratio is from 0.40 to 0.90, in the austenitic stainless steel material, a sufficient dissolved N amount for forming nitrides during use in a high temperature environment will be present, and a sufficient amount of nitrides for refining grains will also be present. Therefore, in the austenitic stainless steel material in a high temperature environment, sufficient stress relaxation cracking resistance and creep strength will be obtained. A preferable lower limit of the dissolved N ratio is 0.45, more preferably is 0.48, further preferably is 0.50, further preferably is 0.55, further preferably is 0.58, further preferably is 0.60 and further preferably is 0.63. A preferable upper limit of the dissolved N ratio is 0.88, more preferably is 0.86, further preferably is 0.85, further preferably is 0.83, further preferably is 0.80, further preferably is 0.78, and further preferably is 0.75.

[Method for Measuring Dissolved N Ratio]

The dissolved N ratio can be measured by the following method. Specifically, the content of N in the steel material (hereinafter, referred to as a "total content of N") is determined by the aforementioned method of chemical analysis. Further, the N amount contained in the residue (hereinafter, referred to as a "residue N amount") is determined by an electrolytic extraction residue method. The obtained total content of N and residue N amount are used to determine the dissolved N ratio by the following formula.

Dissolved N ratio=(1−residue N amount/total content of N)

More specifically, the dissolved N ratio is determined by the following method.

A test specimen is taken from the austenitic stainless steel material. A cross section perpendicular to the longitudinal direction of the test specimen may be circular or may be rectangular. If the austenitic stainless steel material is a steel pipe, the test specimen is taken in a manner so that the center of a cross section perpendicular to the longitudinal direction of the test specimen is the center position of the wall thickness, and the longitudinal direction of the test specimen coincides with the longitudinal direction of the steel pipe. If the austenitic stainless steel material is a steel plate, the test specimen is taken in a manner so that the center of a cross section perpendicular to the longitudinal direction of the test specimen is the center position of the plate thickness, and the longitudinal direction of the test specimen coincides with the longitudinal direction of the steel plate. If the austenitic stainless steel material is a steel bar, the test specimen is taken in a manner so that the center of a cross section perpendicular to the longitudinal direction of the test specimen is the R/2 position of the steel bar, and the longitudinal direction of the test specimen coincides with the longitudinal direction of the steel bar.

The surface of the taken test specimen is polished to remove about 50 μm by preliminary electropolishing to obtain a newly formed surface. The electropolished test specimen is subjected to electrolyzation using an electrolyte solution (10% acetylacetone+1% tetra-ammonium+methanol). The electrolyte solution after electrolyzation is passed through a 0.2 μm filter to capture residue. The obtained residue is subjected to acid decomposition, and the mass of N in the residue is determined by ICP (inductively coupled plasma) emission spectrometry. In addition, the mass of the test specimen before the main electrolyzation and the mass of the test specimen after the main electrolyzation are measured. Then, a value obtained by subtracting the mass of the test specimen after the main electrolyzation from the mass of the test specimen before the main electrolyzation is defined as the base metal mass mainly electrolyzed. The N mass in the residue is divided by the base metal mass mainly electrolyzed to determine the residue N amount (mass %). In other words, the residue N amount (mass %) is determined based on the following formula.

Residue N amount=N mass in residue/base metal mass×100

The total content of N (mass %) in the steel material is determined by the aforementioned well-known component analysis method. The determined total content of N and residue N amount are used to determine the dissolved N ratio by the following formula.

Dissolved N ratio=(1−residue N amount/total content of N)

[Shape of Austenitic Stainless Steel Material of Present Embodiment]

The shape of the austenitic stainless steel material of the present embodiment is not particularly limited. The austenitic stainless steel material of the present embodiment may be a steel pipe, may be a steel plate, or may be a steel bar. Further, the austenitic stainless steel material of the present embodiment may be a forged product.

[Regarding Uses of Austenitic Stainless Steel Material of Present Embodiment]

The austenitic stainless steel material of the present embodiment is suitable for use for apparatuses which are used at an average operation temperature of more than 600 to 750° C. (in other words, in a high temperature environment). The austenitic stainless steel material of the present embodiment is, in addition, suitable for use for apparatuses which are used for a long time period at an average operation temperature of more than 600 to 750° C. after being subjected to welding with higher heat input. Even in a case where the average operation temperature is in the range of more than 600 to 750° C. and the operation temperature temporarily becomes more than 750° C., as long as the average operation temperature is more than 600 to 750° C., it is suitable for use of the austenitic stainless steel material of the present embodiment. The highest temperature reached by these apparatuses may be higher than 750° C. Such apparatuses are, for example, apparatuses in chemical plant facilities that are typified by oil refining facilities and petrochemical facilities. These apparatuses are equipped with, for example, a heating furnace pipe, a tank, and piping.

Note that, the austenitic stainless steel material of the present embodiment can also of course be used for facilities other than chemical plant facilities. Examples of such facilities other than chemical plant facilities include thermal power generation boiler facilities (for example, boiler tubes) for which use at an average operation temperature of around more than 600 to 750° C. is envisioned, similarly to chemical plant facilities.

[Method for Producing Austenitic Stainless Steel Material of Present Embodiment]

A method for producing the austenitic stainless steel material of the present embodiment is described hereinafter. The method for producing an austenitic stainless steel material described hereinafter is one example of a method for producing the austenitic stainless steel material of the present embodiment. Accordingly, an austenitic stainless steel material having the structure described above may be produced by another production method than the production method described hereinafter. However, the production method described hereinafter is a preferable example of a method for producing the austenitic stainless steel material of the present embodiment.

The method for producing the austenitic stainless steel material of the present embodiment includes: a process of preparing a starting material (preparation process); a process of performing hot working on the starting material to produce an intermediate steel material (hot working process); as required, a process of performing cold working after performing a pickling treatment on the intermediate steel material after the hot working process (cold working process); and process of performing a solution treatment on the intermediate steel material after the cold working process (solution treatment process). Hereunder, each of these processes is described.

[Preparation Process]

In the preparation process, a starting material having the aforementioned chemical composition is prepared. The starting material may be supplied by a third party or may be produced. The starting material may be an ingot, a slab, a bloom, or a billet. In the case of producing the starting material, the starting material is produced by the following method. Molten steel having the aforementioned chemical composition is produced. The produced molten steel is used to produce an ingot by an ingot-making process. The produced molten steel may also be used to produce a slab, a bloom, or a billet (cylindrical starting material) by a continuous casting process. Hot working may be performed on the produced ingot, slab, or bloom to produce a billet. For example, hot forging may be performed on the ingot to produce a cylindrical billet, and the billet may be used as a starting material (cylindrical starting material). In such a case, the temperature of the starting material immediately before the start of the hot forging is not particularly limited, and for example is 1000 to 1300° C. The method of cooling the starting material after the hot forging is not particularly limited.

[Hot Working Process]

In the hot working process, hot working is performed on the starting material prepared in the preparation process to produce an intermediate steel material. The intermediate steel material, for example, may be a steel pipe, may be a steel plate, or may be a steel bar.

When the intermediate steel material is a steel pipe, the following working is performed in the hot working process. First, a cylindrical starting material is prepared. A through-hole is formed in the cylindrical starting material along the central axis thereof by machining. Hot extrusion, which is typified by the Ugine-Sejournet process, is performed on the cylindrical starting material in which the through-hole has been formed, to thereby produce an intermediate steel material (steel pipe). The temperature of the starting material immediately before performing the hot extrusion is not particularly limited. The temperature of the starting material immediately before performing the hot extrusion is, for example, 1000 to 1300° C. Instead of the hot extrusion process, a hot hollow forging process may be performed.

Instead of the hot extrusion, a steel pipe may be produced by performing piercing-rolling according to the Mannesmann process. In such a case, a round billet is pierced and rolled with a piercing machine. In the case of performing piercing-rolling, whilst the piercing ratio is not particularly limited, for example the piercing ratio is 1.0 to 4.0. The pierced and rolled round billet is further subjected to hot rolling with a mandrel mill, a reducer, a sizing mill or the like to produce a hollow shell. Whilst the cumulative reduction ratio of area in the hot working process is not particularly limited, for example, the reduction ratio of area is 20 to 80%.

When the intermediate steel material is a steel plate, for example, one or a plurality of rolling machines equipped with a pair of work rolls is used in the hot working process. Hot rolling is performed on the starting material, such as a slab, using the rolling machine to produce a steel plate. The starting material is heated before the hot rolling. The hot rolling is performed on the heated starting material. The temperature of the starting material immediately before the hot rolling is, for example, 1000 to 1300° C.

When the intermediate steel material is a steel bar, the hot working process includes, for example, a rough rolling process and a finish rolling process. In the rough rolling process, hot working is performed on the starting material to produce a billet. In the rough rolling process, for example, a blooming machine is used. The blooming machine is used to subject the starting material to blooming to produce a billet. If a continuous mill is arranged downstream of the blooming machine, the continuous mill may be used to further perform hot rolling on the billet obtained after performing the blooming, to thereby produce a billet of an even smaller size. In the continuous mill, for example, horizontal stands having a pair of horizontal rolls and vertical stands having a pair of vertical rolls are alternately arranged in a row. In the rough rolling process, a billet is produced from the starting material, such as a bloom. Whilst the starting material temperature immediately before the rough rolling process is not particularly limited, for example, the starting material temperature is 1000 to 1300° C. In the finish rolling process, the billet is first heated. Hot rolling is performed on the heated billet using the continuous mill to produce a steel bar. Whilst the heating temperature in the heating furnace in the finish rolling process is not particularly limited, for example, the heating temperature is 1000 to 1300° C.

The intermediate steel material after hot working is allowed to cool for a certain time period, and thereafter is rapidly cooled. The conditions for the rapid cooling are as follows.

Time t1 from completion of hot working until start of rapid cooling: 0.50 min to 5.00 min Intermediate steel material temperature T1 at start of rapid cooling: 700° C. or more Cooling rate CR1 from completion of hot working until start of rapid cooling: 15° C./min or more

[Time t1 from Completion of Hot Working Until Start of Rapid Cooling]

The time t1 (min) from completion of hot working until the start of rapid cooling will be referred to herein as "standing time" t1. In the case of rapidly cooling the intermediate steel material after hot working, a water cooler is used. The intermediate steel material is rapidly cooled (water-cooled) by the water cooler. During the period from completion of hot working until the start of rapid cooling, the intermediate steel material is, intentionally, left to stand for a certain time period. By this means, formation of nitrides is promoted. If the standing time t1 is shorter than 0.50 minutes, rapid cooling will be started in a state in which nitrides have not sufficiently formed. In this case, even if the other conditions of the hot working process as well as conditions of the solution treatment process to be described later are satisfied, the dissolved N ratio will be more than 0.90, and the nitrides will be insufficient. Consequently, the pinning effect will not be sufficiently obtained, grains will coarsen, and the stress relaxation cracking resistance of the steel material will decrease. On the other hand, if the standing time t1 is longer than 5.00 minutes, a large amount of nitrides will form in the intermediate steel material during the standing time t1. In this case, even if the other conditions of the hot working process as well as conditions of the solution treatment process to be described later are satisfied, the dissolved N ratio will be less than 0.40%, and the dissolved N amount will be insufficient. In this case, during use in a high temperature environment, fine nitrides will not sufficiently precipitate in Cr depleted zones. Consequently, the stress relaxation cracking resistance of the steel material and the creep strength will decrease. If the standing time t1 is within the range of 0.50 minutes to 5.00 minutes, on the premise that the other production conditions are satisfied, the dissolved N ratio will be 0.40 to 0.90 and excellent stress relaxation cracking resistance and creep strength will be obtained. A preferable upper limit of the standing time t1 is 4.50 minutes, more preferably is 4.00 minutes, and further preferably is 3.50 minutes.

[Temperature T1 of Intermediate Steel Material at Start of Rapid Cooling]

The temperature T1 (° C.) of the intermediate steel material at the start of rapid cooling is referred to herein as "rapid cooling starting temperature" T1. If the rapid cooling starting temperature T1 is less than 700° C., coarse nitrides will form in the intermediate steel material during the standing time t1. Further, Cr carbides will form at the grain boundaries. In this case, during the standing time t1, coarse growth of nitrides will occur in the intermediate steel material, and Cr carbides at the grain boundaries will coarsen. In this case, the dissolved N ratio will be less than 0.40, and the stress relaxation cracking resistance and creep strength will decrease. If the rapid cooling starting temperature T1 is 700° C. or more, in the intermediate steel material during the standing time t1, the pinning effect produced by fine nitrides will also act, and coarsening of grains will be suppressed. Therefore, the grains of the intermediate steel material after the rapid cooling will be kept fine. As a result, on the premise that the other production conditions are satisfied, the dissolved N ratio will be 0.40 to 0.90 and excellent stress relaxation cracking resistance and creep strength will be obtained. A preferable lower limit of the rapid cooling starting temperature T1 is 750° C., more preferably is 780° C., further preferably is more than 790° C., and further preferably is 800° C.

[Cooling Rate CR1 from Completion of Hot Working Until Start of Rapid Cooling]

If a cooling rate CR1 (° C./min) from completion of the hot working until the start of rapid cooling is less than 15° C./min, coarse nitrides will form in the intermediate steel material during the standing time t1. Further, Cr carbides will form at the grain boundaries. In this case, the dissolved N ratio will be less than 0.40, and the stress relaxation cracking resistance and creep strength will decrease. If the cooling rate CR1 is 15° C./min or more, on the premise that the other production conditions are satisfied, the dissolved N ratio will be 0.40 to 0.90 and excellent stress relaxation cracking resistance and creep strength will be obtained. A preferable lower limit of the cooling rate CR1 is 18° C./min, and more preferably is 20° C./min Note that, the cooling rate CR1 is a value obtained by dividing a difference between the surface temperature of the intermediate steel material immediately after the completion of hot working and the surface temperature of the intermediate steel material immediately before the start of rapid cooling by the standing time t1.

[Cold Working Process]

A cold working process is performed as required. In other words, a cold working process need not be performed. In the case of performing a cold working process, cold working is performed after performing a pickling treatment on the intermediate steel material. When the intermediate steel material is a steel pipe or a steel bar, the cold working is, for example, cold drawing. When the intermediate steel material is a steel plate, the cold working is, for example, cold rolling. By performing the cold working process, strain is imparted to the intermediate steel material before the solution treatment process. This allows the development of recrystallization and formation of uniform grains to occur during the solution treatment process. Whilst the reduction ratio of area in the cold working process is not particularly limited, for example, the reduction ratio of area is 10 to 90%.

[Solution Treatment Process]

In the solution treatment process, the intermediate steel material after the hot working process or after the cold working process is subjected to a solution treatment. The solution treatment is performed by the following method. The intermediate steel material is charged into a heat treatment furnace in which the atmosphere inside the furnace is an atmosphere. Here, the term "atmosphere" means an atmosphere containing 78% or more by volume of nitrogen and 20% or more by volume of oxygen, which are gases that constitute the atmosphere. Inside the furnace with the atmosphere, the intermediate steel material is held at a solution treatment temperature, and thereafter is rapidly cooled at a cooling rate to be described later. By controlling a solution treatment temperature T2 in the solution treatment and a cooling rate CR2 in the following manner, the dissolved N ratio can be made 0.4 to 0.9 in the austenitic stainless steel material having the chemical composition described above.

Solution treatment temperature T2: 1020 to 1350° C.

Cooling rate CR2: 5° C./sec or more

[Solution Treatment Temperature T2: 1020 to 1350° C.]

If the solution treatment temperature T2 is less than 1020° C., in some cases Cr carbides or CrN will not dissolve sufficiently. In this case, the dissolved N ratio in the steel material will be low, and will be less than 0.40. On the other hand, if the solution treatment temperature T2 is more than 1350° C., nitrides in the steel material will dissolve, and the dissolved N ratio will be more than 0.90.

If the solution treatment temperature T2 is 1020 to 1350° C., on the premise that the other conditions are also satisfied, the dissolved N ratio will fall within the range of 0.40 to 0.90. A preferable lower limit of the solution treatment temperature T2 is 1030° C. A preferable upper limit of the solution treatment temperature T2 is 1300° C., and more preferably is 1250° C. Note that, a holding time at the solution treatment temperature T2 is not particularly limited. The holding time at the solution treatment temperature T2 is, for example, two minutes or more. Although the upper limit of the holding time is not particularly limited, for example, the upper limit is 500 minutes.

[Cooling Rate CR2: 5° C./Sec or More]

After being held at the solution treatment temperature T2, the steel material is cooled at the cooling rate CR2 of 5° C./sec or more at least when the steel material temperature is in the temperature range of 1000 to 600° C. Here, the term "cooling rate CR2" means the average cooling rate (° C./sec) when the steel material temperature is in the temperature range of 1000 to 600° C. In a case where the cooling rate CR2 is less than 5° C./sec, an excessively large amount of coarse nitrides will precipitate during cooling. As a result, the dissolved N ratio will be less than 0.40.

If the cooling rate CR2 is 5° C./sec or more, during cooling in the temperature range of 1000 to 600° C., formation of an excessively large amount of nitrides in the steel material can be suppressed. As a result, on the premise that the other conditions are also satisfied, the dissolved N ratio will fall within the range of 0.40 to 0.90. A preferable lower limit of the cooling rate CR2 is 6° C./sec, and further preferably is 7° C./sec. The rapid cooling method may be water cooling or may be oil cooling.

The austenitic stainless steel material of the present embodiment can be produced by the processes described above. The production method described above is one example of a method for producing the austenitic stainless steel material of the present embodiment. Therefore, a method for producing the austenitic stainless steel material of the present embodiment is not limited to the production method described above. As long as the austenitic stainless steel material of the present embodiment has the aforementioned chemical composition and the dissolved N ratio is 0.40 to 0.90, a method for producing the austenitic stainless steel material of the present embodiment is not limited to the production method described above.

As described above, in the austenitic stainless steel material of the present embodiment, the content of each element in the chemical composition is within the aforementioned numerical value range, and the dissolved N ratio is 0.40 to 0.90. Therefore, the austenitic stainless steel material of the present embodiment has high creep strength and also has excellent stress relaxation cracking resistance even when, after welding with higher heat input, the austenitic stainless steel material is used for a long time period at an average operation temperature of more than 600 to 750° C.

Note that, in a case where the austenitic stainless steel material of the present embodiment is welded to make a welded joint, the welded joint is produced by the following method.

The austenitic stainless steel material of the present embodiment is prepared as a base metal. A bevel is then formed in the prepared base metal. Specifically, a bevel is formed in an end of the base metal by a well-known processing method. The bevel shape may be a V shape, may be a U shape, may be an X shape, or may be a shape other than a V shape, a U shape or an X shape.

Welding is performed on the prepared base metal to produce a welded joint. Specifically, two base metals in which a bevel has been formed are prepared. The bevels of the prepared base metals are butted together. Welding using the aforementioned welding consumable is then performed on the portion where the pair of bevels are butted together, to thereby form a weld metal having the aforementioned chemical composition.

The welding method may be single pass welding or may be multi pass welding. The welding methods include, for example, gas tungsten arc welding (GTAW), shielded metal arc welding (SHAW), flux cored arc welding (FCAW), gas metal arc welding (GMAW), and submerged arc welding (SAW). A welded joint in which the austenitic stainless steel material of the present embodiment is used can be produced by the production process described above.

EXAMPLE

[Production of Austenitic Stainless Steel Material]

Molten steels having the chemical compositions shown in Table 1 were produced.

TABLE 1

| Test | Chemical Composition (unit is mass %; balance is Fe and impurities) | | | | | | | | | | | |
|---|---|---|---|---|---|---|---|---|---|---|---|---|
| | Essential Elements | | | | | | | | | | | Optional |
| Number | C | Si | Mn | P | S | Cr | Ni | N | Nb | Mo | B | Elements |
| A1 | 0.011 | 0.28 | 1.34 | 0.023 | 0.0005 | 17.00 | 9.93 | 0.083 | 0.38 | 0.38 | 0.0018 | |
| A2 | 0.023 | 0.48 | 1.27 | 0.016 | 0.0005 | 17.13 | 10.21 | 0.086 | 0.38 | 0.46 | 0.0028 | |
| A3 | 0.011 | 0.37 | 1.44 | 0.023 | 0.0005 | 17.06 | 10.03 | 0.087 | 0.39 | 0.36 | 0.0015 | |
| A4 | 0.012 | 0.31 | 1.41 | 0.026 | 0.0005 | 17.15 | 9.88 | 0.090 | 0.37 | 0.42 | 0.0015 | Ti: 0.06 |
| A5 | 0.008 | 0.35 | 1.37 | 0.022 | 0.0005 | 17.04 | 9.87 | 0.078 | 0.36 | 0.36 | 0.0017 | Ta: 0.05 |
| A6 | 0.011 | 0.36 | 1.44 | 0.025 | 0.0005 | 17.10 | 9.92 | 0.081 | 0.47 | 0.37 | 0.0018 | W: 0.22 |
| A7 | 0.012 | 0.33 | 1.38 | 0.028 | 0.0005 | 17.22 | 9.86 | 0.088 | 0.38 | 0.32 | 0.0017 | Cu: 0.38 |
| A8 | 0.010 | 0.41 | 1.38 | 0.024 | 0.0005 | 17.27 | 9.89 | 0.091 | 0.37 | 0.24 | 0.0017 | Al: 0.022 |
| A9 | 0.008 | 0.41 | 1.62 | 0.026 | 0.0006 | 17.14 | 9.92 | 0.087 | 0.43 | 0.31 | 0.0019 | Ca: 0.0023 |
| A10 | 0.023 | 0.48 | 1.27 | 0.016 | 0.0005 | 17.13 | 10.21 | 0.086 | 0.38 | 0.46 | 0.0028 | REM: 0.002 |
| A11 | 0.009 | 0.32 | 1.41 | 0.021 | 0.0005 | 17.37 | 9.91 | 0.089 | 0.41 | 0.24 | 0.0014 | Sn: 0.006 |
| A12 | 0.011 | 0.45 | 1.38 | 0.023 | 0.0005 | 17.16 | 10.01 | 0.087 | 0.43 | 0.32 | 0.0016 | Zn: 0.003 |
| A13 | 0.009 | 0.34 | 1.47 | 0.021 | 0.0005 | 17.21 | 9.81 | 0.092 | 0.42 | 0.44 | 0.0022 | V: 0.14, W: 0.40, Al: 0.018, Ca: 0.0019 |
| A14 | 0.013 | 0.29 | 1.35 | 0.024 | 0.0005 | 17.24 | 10.12 | 0.096 | 0.39 | 0.35 | 0.0016 | Ti: 0.04. Al: 0.035 |
| A15 | 0.008 | 0.22 | 0.46 | 0.018 | 0.0006 | 17.18 | 13.15 | 0.098 | 0.33 | 1.08 | 0.0028 | V: 0.23, Cu: 1.95, Co: 0.18, Al: 0.032, Ca: 0.0020. Mg: 0.0018, |

TABLE 1-continued

| Test | Chemical Composition (unit is mass %; balance is Fe and impurities) | | | | | | | | | | | |
|---|---|---|---|---|---|---|---|---|---|---|---|---|
| | Essential Elements | | | | | | | | | | | Optional |
| Number | C | Si | Mn | P | S | Cr | Ni | N | Nb | Mo | B | Elements |
| A16 | 0.009 | 0.24 | 0.66 | 0.017 | 0.0005 | 17.21 | 12.18 | 0.112 | 0.34 | 0.77 | 0.0032 | Pb: 0.001 Cu: 3.11 |
| A17 | 0.010 | 0.31 | 1.14 | 0.020 | 0.0005 | 17.05 | 13.86 | 0.105 | 0.35 | 3.12 | 0.0012 | |
| B1 | 0.037 | 0.38 | 1.48 | 0.031 | 0.0006 | 18.02 | 10.51 | 0.062 | 0.47 | 0.08 | 0.0006 | |
| B2 | 0.008 | 0.32 | 1.49 | 0.024 | 0.0005 | 17.43 | 9.93 | 0.062 | | 0.28 | 0.0012 | |
| B3 | 0.028 | 0.33 | 1.42 | 0.026 | 0.0016 | 17.28 | 9.98 | 0.005 | 0.48 | 0.07 | 0.0007 | |
| B4 | 0.029 | 0.29 | 1.46 | 0.022 | 0.0006 | 17 02 | 10.06 | 0.096 | 0.47 | | 0.0007 | |
| B5 | 0.027 | 0.28 | 1.51 | 0.029 | 0.0005 | 17.92 | 10.61 | 0.060 | 0.24 | 0.10 | | |
| B6 | 0.028 | 0.39 | 1.35 | 0.021 | 0.0005 | 17.18 | 10.04 | 0.086 | 0.47 | 0.07 | 0.0007 | |
| B7 | 0.022 | 0.41 | 1.42 | 0.024 | 0.0006 | 17.25 | 9.89 | 0.094 | 0.46 | 0.11 | 0.0008 | |
| B8 | 0.021 | 0.33 | 1.47 | 0.021 | 0.0007 | 17.17 | 10.05 | 0.096 | 0.45 | 0.08 | 0.0008 | |
| B9 | 0.023 | 0.37 | 1.38 | 0.019 | 0.0005 | 17.19 | 10.27 | 0.092 | 0.48 | 0.12 | 0.0007 | |
| B10 | 0.025 | 0.44 | 1.29 | 0.023 | 0.0007 | 17.36 | 9.77 | 0.074 | 0.22 | 0.05 | 0.0006 | |
| B11 | 0.028 | 0.41 | 1.46 | 0.026 | 0.0005 | 17.09 | 10.12 | 0.066 | 0.23 | 0.06 | 0.0007 | |

In Table 1, a blank space indicates that the content of the corresponding element was less than the detection limit. When the content was less than the detection limit, the relevant element was regarded as not being contained in the chemical composition.

Ingots which had an outer diameter of 120 mm and a weight of 30 kg were produced using molten steel. Each ingot was subjected to hot forging to produce a starting material having a thickness of 30 mm. The temperature of the ingot before the hot forging was 1250° C. In addition, the starting material was subjected to hot rolling, and the steel material after hot rolling was rapidly cooled (water-cooled) to produce an intermediate steel material (steel plate) having a thickness of 15 mm. At that time, the starting material temperature before hot working (hot rolling) was varied within the range of 1050 to 1250° C. In addition, the standing time t1 (min) from after the completion of hot working until starting rapid cooling (water-cooling), the rapid cooling starting temperature T1 (° C.), and the cooling rate CR1 (° C./min) from completion of hot working until the start of rapid cooling were varied. The standing time t1 in Test Numbers A1 to A17, B1 to B5, B7 to B9, and B11 was 0.50 to 5.00 minutes. On the other hand, the standing time t1 in Test Number B6 was 6.00 to 7.00 minutes. The standing time t1 in Test Number B10 was 0.25 minutes. Further, the rapid cooling starting temperature T1 in Test Numbers A1 to A17, B1 to B6, and B8 to B11 was 700° C. or more. On the other hand, the rapid cooling starting temperature T1 in Test Number B7 was 600 to 650° C. Further, the cooling rate CR1 in Test Numbers A1 to A17, B1 to B7, and B10 to B11 was 15° C./min or more. On the other hand, the cooling rate CR1 in Test Numbers B8 and B9 was 10° C./min or less.

The intermediate steel material after hot rolling was subjected to a solution treatment. The solution treatment temperature T2 in the solution treatment was within the range of 1050 to 1250° C., and the holding time at the solution treatment temperature T2 was 10 minutes for each test number. Further, the cooling rate CR2 was 10 to 20° C./sec for each test number. Note that, the intermediate steel material of Test Number B11 was not subjected to the solution treatment. The austenitic stainless steel material of each test number was produced by the above process.

TABLE 2

| Test Number | Dissolved N Ratio | SR Cracking Test | Creep Strength |
|---|---|---|---|
| A1 | 0.72 | E | E |
| A2 | 0.72 | E | E |
| A3 | 0.71 | E | E |
| A4 | 0.74 | E | E |
| A5 | 0.70 | E | E |
| A6 | 0.68 | E | E |
| A7 | 0.71 | E | E |
| A8 | 0.73 | E | E |
| A9 | 0.72 | E | E |
| A10 | 0.74 | E | E |
| A11 | 0.75 | E | E |
| A12 | 0.75 | E | E |
| A13 | 0.76 | E | E |
| A14 | 0.79 | E | E |
| A15 | 0.73 | E | E |
| A16 | 0.74 | E | E |
| A17 | 0.77 | E | E |
| B1 | 0.58 | B | E |
| B2 | 0.98 | B | B |
| B3 | 0.95 | B | B |
| B4 | 0.87 | B | E |
| B5 | 0.86 | B | E |
| B6 | 0.37 | B | B |
| B7 | 0.39 | B | B |
| B8 | 0.38 | B | B |
| B9 | 0.38 | B | B |
| B10 | 0.94 | B | E |
| B11 | 0.31 | B | B |

[Analysis of Chemical Composition of Steel Material]

The chemical composition of the austenitic stainless steel material of each test number was determined by the following method. A drill with a diameter of 5 mm was used to perform piercing at the center position of the plate width and also at the center position of the plate thickness of the steel material (steel plate) to generate machined chips, and the machined chips were collected. The collected machined chips were dissolved in acid to obtain a liquid solution. The liquid solution was subjected to ICP-AES, and elementary analysis of the chemical composition was performed. The content of C and the content of S were determined by a well-known high-frequency combustion method (combustion-infrared absorption method). The content of N was determined using a well-known inert gas fusion-thermal conductivity method. Table 1 shows the chemical compositions of the steel materials of the respective test numbers that were determined as a result.

[Measurement of Dissolved N Ratio]

The dissolved N ratio of the austenitic stainless steel material of each test number was determined by the following method. A test specimen was taken from the austenitic stainless steel material (steel plate). Specifically, the test specimen was taken in a manner so that the center of the cross section perpendicular to the longitudinal direction of the test specimen was the center position of the plate thickness, and the longitudinal direction of the test specimen coincided with the longitudinal direction of the steel plate.

The surface of the taken test specimen was polished to remove about 50 μm by preliminary electropolishing to obtain a newly formed surface. The electropolished test specimen was subjected to electrolyzation using an electrolyte solution (10% acetylacetone+1% tetra-ammonium+methanol). The electrolyte solution after electrolyzation was passed through a 0.2 μm filter to capture residue. The obtained residue was subjected to acid decomposition, and the mass of N in the residue was determined by ICP (inductively coupled plasma) emission spectrometry. In addition, the mass of the test specimen before the main electrolyzation and the mass of the test specimen after the main electrolyzation were measured. Then, a value obtained by subtracting the mass of the test specimen after the main electrolyzation from the mass of the test specimen before the main electrolyzation was defined as the base metal mass mainly electrolyzed. The N mass in the residue was divided by the base metal mass mainly electrolyzed to determine the residue N amount (mass %). In other words, the residue N amount (mass %) was determined based on the following formula.

Residue N amount=N mass in residue/base metal mass×100

The dissolved N ratio was determined by the following formula using the content of N (total content of N (mass %)) in the steel material and the residue N amount (mass %) which were obtained by the above analysis of the chemical composition of the steel material.

Dissolved N ratio=(1−residue N amount/total content of N)

The dissolved N ratio of each test number is shown in Table 2.

[Preparation of Test Specimen Simulated Big Heat Input Welding]

Test specimens simulated big heat input welding which simulated welding with higher heat input were prepared by the following method using the produced austenitic stainless steel materials.

For each test number, a square type test specimen was taken that included the center position of the plate width and the center position of the plate thickness of the austenitic stainless steel material. The longitudinal direction of the square type test specimen was parallel with the longitudinal direction of the austenitic stainless steel material. The length of the square type test specimen was 100 mm. A cross section (transverse cross-section) perpendicular to the longitudinal direction of the square type test specimen was a rectangle with dimensions of 10 mm×10 mm. The center position of the transverse cross-section of the square type test specimen approximately coincided with the center position of the plate width and the center position of the plate thickness of the austenitic stainless steel material.

A high frequency heat cycle apparatus was used to apply the following heat history to the square type test specimen. The square type test specimen was raised from normal temperature to 1400° C. at a rate of 70° C./sec in the atmosphere. In addition, the temperature was held at 1400° C. for 10 seconds. Thereafter, the square type test specimen was cooled to normal temperature at a cooling rate of 20° C./sec. A test specimen simulated big heat input welding was prepared by applying the heat history described above to the square type test specimen.

[Stress Relaxation Cracking Resistance Evaluation Test (SR Cracking Evaluation Test)]

A stress relaxation cracking resistance test conforming to ASTM E328-02 was performed using a test specimen simulated big heat input welding. A test specimen for an SR cracking evaluation test was prepared from the test specimen simulated big heat input welding. The test specimen was formed into a flanged creep test specimen having a length of 80 mm and a GL of 30 mm. A test jig for deflection displacement loading was used to apply a cold strain of 10% at room temperature in the heating furnace to the test specimen. The test specimen in the heating furnace was heated to 650° C., and a further strain of 10% was applied to the test specimen at 650° C., and the test specimen was then held for 1000 hours.

After 1000 hours had passed, the test specimen was allowed to cool to room temperature. If the test specimen after being allowed to cool was ruptured, it was determined that the stress relaxation cracking resistance was low (described as "B" (Bad) in the "SR Cracking Test" column in Table 2). Further, if the test specimen after 1000 hours had passed was not ruptured, microstructure observation of the cross section perpendicular to the longitudinal direction of the test specimen was conducted using a scanning electron microscope (SEM). At that time, the magnification was set to ×2000. If the result of the microstructure observation indicated that cracking had occurred at grain boundaries or that creep voids had occurred, it was determined that the stress relaxation cracking resistance was low (described as "B" (Bad) in the "SR Cracking Test" column in Table 2). On the other hand, if the occurrence of cracking at grain boundaries could not be confirmed and the occurrence of creep voids could also not be confirmed in the microstructure observation using the SEM, it was determined that the stress relaxation cracking resistance was high (described as "E" (Excellent) in the "SR Cracking Test" column in Table 2).

[Creep Strength Evaluation Test (Creep Rupture Test)]

The aforementioned test specimen simulated big heat input welding was processed to prepare a creep rupture test specimen conforming to JIS Z2271 (2010). The cross section perpendicular to the axial direction of the creep rupture test specimen was circular, the outer diameter of the creep rupture test specimen was 6 mm, and the parallel portion was 30 mm.

A creep rupture test conforming to JIS Z2271 (2010) was conducted using the prepared creep rupture test specimen. Specifically, after heating the creep rupture test specimen at 650° C., the creep rupture test was conducted. The test stress was set to 118 MPa, and the creep-rupture time (hours) was determined.

With regard to the creep strength, if the creep-rupture time was 6000 hours or more, it was determined that the creep strength of the steel material was excellent in a high temperature environment (described as "E" (Excellent) in the "Creep Strength" column in Table 2). If the creep-rupture time was less than 6000 hours, it was determined that the creep strength of the steel material was low in a high temperature environment of more than 600° C. (described as "B" (Bad) in the "Creep Strength" column in Table 2).

[Test Results]

The test results are shown in Table 2. Referring to Table 1 and Table 2, in each of Test Numbers A1 to A17, the content of each element in the chemical composition was appropriate and the dissolved N ratio was within the range of 0.40 to 0.90. Therefore, high creep strength was obtained and the stress relaxation cracking resistance was high.

On the other hand, in Test Number B1 the content of C was too high. Consequently, the stress relaxation cracking resistance was low.

In Test Number B2, the content of Nb was low. Consequently, the stress relaxation cracking resistance and the creep strength were low.

In Test Number B3, the content of N was low. Consequently, the stress relaxation cracking resistance and the creep strength were low.

In Test Number B4, the content of Mo was low. Consequently, the stress relaxation cracking resistance was low.

In Test Number B5, the content of B was low. Consequently, the stress relaxation cracking resistance was low.

In Test Number B6, the standing time t1 in the hot working process was too long. Consequently; the dissolved N ratio was less than 0.40. As a result, the stress relaxation cracking resistance and the creep strength were low.

In Test Number B7, the rapid cooling starting temperature T1 in the hot working process was too low. Consequently, the dissolved N ratio was less than 0.40. As a result, the stress relaxation cracking resistance and the creep strength were low.

In Test Numbers B8 and B9, the cooling rate CR1 from the completion of hot working to the start of rapid cooling was too slow. Consequently, the dissolved N ratio was less than 0.40. As a result, the stress relaxation cracking resistance and the creep strength were too low.

In Test Number B10, the standing time t1 from the completion of hot working to the start of rapid cooling was too short. Consequently, the dissolved N ratio was more than 0.90. As a result, the stress relaxation cracking resistance was low.

In Test Number B11, a solution treatment was not performed. Consequently, the dissolved N ratio was less than 0.40. As a result, the stress relaxation cracking resistance and the creep strength were low.

Embodiment of the present invention have been described above. However, the foregoing embodiments are merely examples for implementing the present invention. Accordingly, the present invention is not limited to the above embodiments, and the above embodiments can be appropriately modified and implemented within a range that does not deviate from the gist of the present invention.

The invention claimed is:

1. An austenitic stainless steel material, comprising:

a chemical composition consisting of, in mass %,

C: 0.030% or less,

Si: 1.50% or less,

Mn: 2.00% or less,

P: 0.045% or less,

S: 0.0300% or less,

Cr: 15.00 to 25.00%,

Ni: 8.00 to 20.00%,

N: 0.050 to 0.250%,

Nb: 0.10 to 1.00%,

Mo: 0.05 to 5.00%,

B: 0.0005 to 0.0100%,

Ti: 0 to 0.50%,

Ta: 0 to 0.50%,

V: 0 to 1.00%,

Zr: 0 to 0.10%,

Hf: 0 to 0.10%,

Cu: 0 to 4.00%,

W: 0 to 5.00%,

Co: 0 to 1.00%, sol. Al: 0 to 0.100%,

Ca: 0 to 0.0200%,

Mg: 0 to 0.0200%, rare earth metal: 0 to 0.100%,

Sn: 0 to 0.010%,

As: 0 to 0.010%,

Zn: 0 to 0.010%,

Pb: 0 to 0.010%, and

Sb: 0 to 0.010%, with the balance being Fe and impurities, wherein a ratio of a dissolved N amount (mass %) in the austenitic stainless steel material with respect to a content of N (mass %) in the austenitic stainless steel material is 0.40 to 0.90.

2. The austenitic stainless steel material according to claim 1, wherein the chemical composition contains at least one or more elements belonging to any group among a first group to a fourth group:

first group:

Ti: 0.01 to 0.50%,

Ta: 0.01 to 0.50%,

V: 0.01 to 1.00%,

Zr: 0.01 to 0.10%, and

Hf: 0.01 to 0.10%;

second group:

Cu: 0.01 to 4.00%,

W: 0.01 to 5.00%, and

Co: 0.01 to 1.00%:

third group:

sol. Al: 0.001 to 0.100%;

fourth group:

Ca: 0.0001 to 0.0200%,

Mg: 0.0001 to 0.0200%, and rare earth metal: 0.001 to 0.100%.

* * * * *